US009169113B2

(12) United States Patent
Grampassi

(10) Patent No.: US 9,169,113 B2
(45) Date of Patent: Oct. 27, 2015

(54) APPARATUS FOR PREPARING CARBONATED REFRIGERATED BEVERAGES

(75) Inventor: Enrico Grampassi, Spilamberto (IT)

(73) Assignee: S.P.M. DRINK SYSTEMS S.P.A., Spilamberto (MO) (IT)

( * ) Notice: Subject to any disclaimer, the term of this patent is extended or adjusted under 35 U.S.C. 154(b) by 65 days.

(21) Appl. No.: 14/005,666

(22) PCT Filed: Mar. 16, 2012

(86) PCT No.: PCT/EP2012/054662

§ 371 (c)(1), (2), (4) Date: Sep. 17, 2013

(87) PCT Pub. No.: WO2012/126829

PCT Pub. Date: Sep. 27, 2012

(65) Prior Publication Data

US 2014/0008386 A1 Jan. 9, 2014

(30) Foreign Application Priority Data

Mar. 18, 2011 (IT) ..... BO2011A000133

(51) Int. Cl.

*B67D 1/04* (2006.01)
*B01F 3/04* (2006.01)
*B67D 1/00* (2006.01)
(Continued)

(52) U.S. Cl.

CPC ..... *B67D 1/0406* (2013.01); *B01F 3/04531* (2013.01); *B01F 3/04808* (2013.01); *B67D 1/0016* (2013.01); *B67D 1/0043* (2013.01); *B67D 1/0057* (2013.01); *B67D 1/0075* (2013.01); *B67D 1/0857* (2013.01); *B67D 1/125* (2013.01); *B67D 1/1234* (2013.01); *B67D 1/1252* (2013.01); *B67D 1/1272* (2013.01)

(58) Field of Classification Search

CPC ..... B01F 3/04531; B01F 3/04808; B67D 1/0016; B67D 1/0043; B67D 1/0057; B67D 1/0075; B67D 1/0406; B67D 1/0857; B67D 1/1234; B67D 1/125; B67D 1/1252; B67D 1/1272

USPC ..... 222/61, 146.6, 64, 394, 129.1

See application file for complete search history.

(56) References Cited

U.S. PATENT DOCUMENTS 2,702,047 A * 2/1955 Gilmont ..... 137/495
3,206,069 A 9/1965 Jacobs et al.
(Continued)

FOREIGN PATENT DOCUMENTS

DE 101 28 620 A1 12/2002
DE 10128620 A1 * 12/2002
(Continued)

*Primary Examiner* — Donnell Long
(74) *Attorney, Agent, or Firm* — McGlew and Tuttle, P.C.

(57) ABSTRACT

The apparatus for preparing carbonated refrigerated beverages comprises at least one containment tank (2) suitable to contain the product to be dispensed and closed by a pressure tightening lid (4); means for feeding the product to be dispensed inside said containment tank (2); and means for feeding a pressurization gas inside said containment tank (2) to maintain the same tank (2) under pressure. The feed means of the pressurization gas comprise single feed and discharge ducts (21, 22) for the pressurization gas, separately connected to said tank (2) and provided with respective valve members (23, 24) for controlling the flow of the same pressurization gas.

20 Claims, 3 Drawing Sheets

(51) Int. Cl.
*B67D 1/08* (2006.01)
*B67D 1/12* (2006.01)

(56) References Cited

U.S. PATENT DOCUMENTS 3,209,596 A * 10/1965 Kelly ..... 73/705
4,011,102 A * 3/1977 Magnollay ..... 134/57 R
5,553,746 A * 9/1996 Jones ..... 222/129.1
2007/0023723 A1 * 2/2007 Magri ..... 251/129.21

FOREIGN PATENT DOCUMENTS

EP 0 919 518 A2 6/1999
EP 1 088 784 A1 4/2001

* cited by examiner

Fig.3
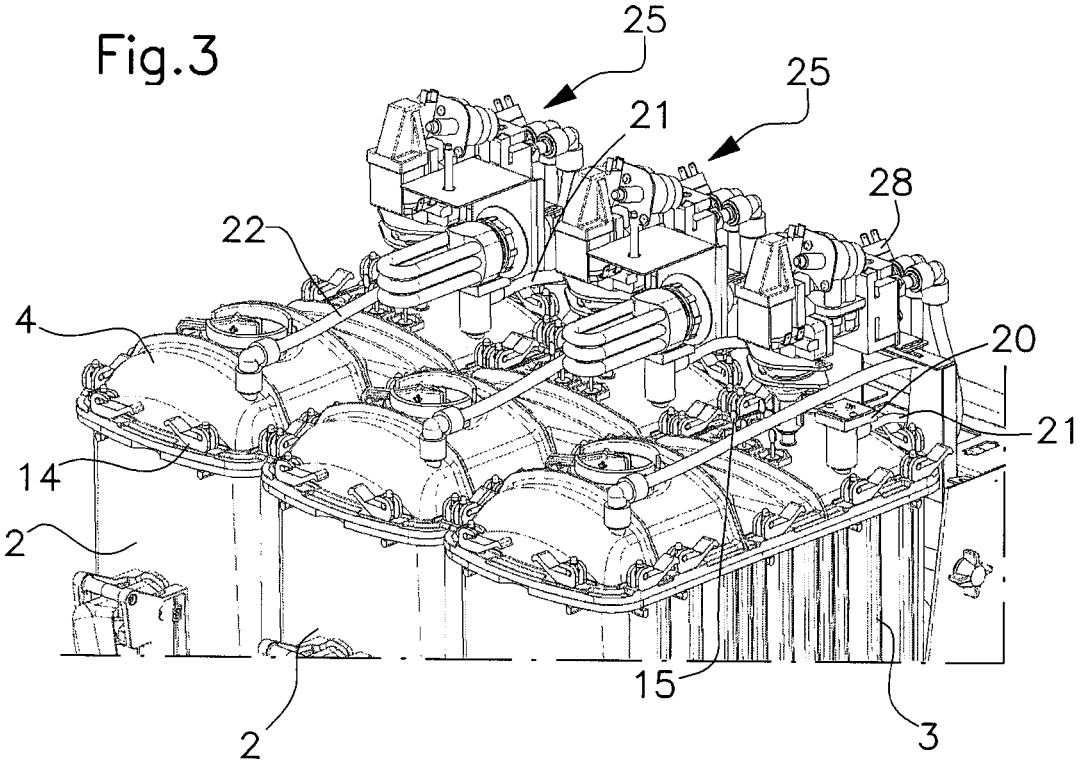
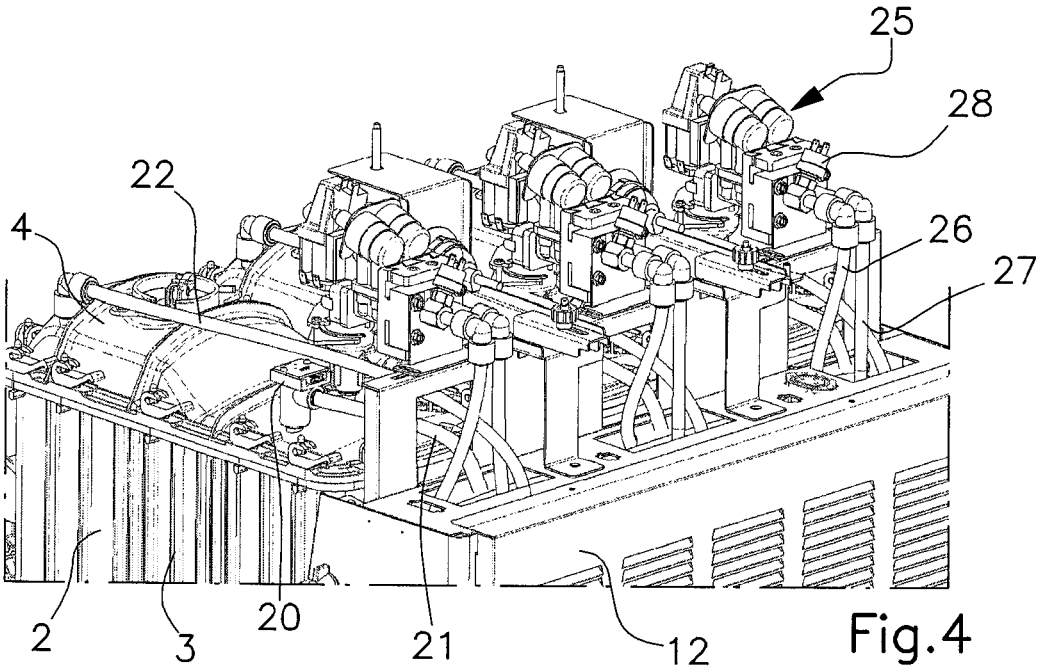
Fig.4

Fig.5
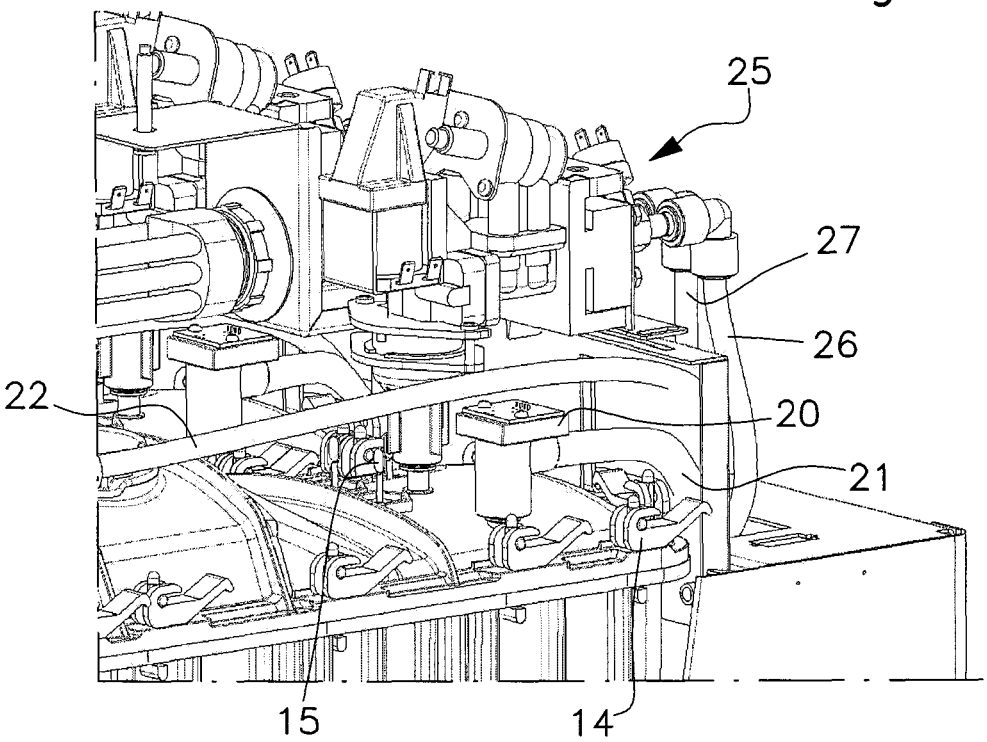
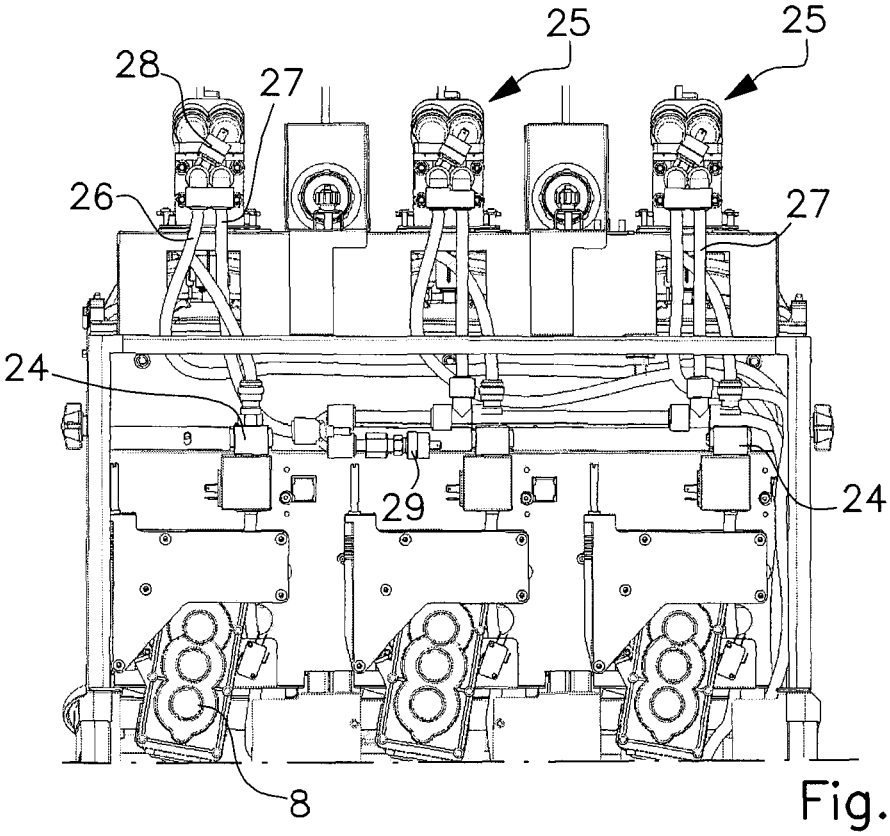
Fig.6

APPARATUS FOR PREPARING CARBONATED REFRIGERATED BEVERAGES

TECHNICAL FIELD

The present invention regards an apparatus for preparing and dispensing carbonated refrigerated beverages, such as for example carbonated crushed-ice beverages and the like.

BACKGROUND ART

Apparatuses which al low to prepare and dispense instantaneously carbonated refrigerated beverages, of the type of the carbonated crushed-ice beverages and the like, have been known nowadays.

Such known apparatuses generally consist of one or more tanks suitable to contain the product to be prepared and dispensed, fed to the same tanks through a suitable valve member in which a mixing of the concentrated product with carbonated water is performed, according to a suitable proportion. In each tank are arranged a cooling device for cooling the product to the desired temperature and a mixing device which determines the continuous circulation of the product inside the tank. The circulation member, constituted for example by a screw member driven in rotation about an axis longitudinal to the tank, is suitable for conveying the cooled product towards a frontal zone, where a dispenser device for dispensing the product is arranged. The dispenser device is provided with an obturator element which can be actuated by an external lever member.

To each containment tank are connected means for feeding carbonic anhydride to maintain the same tank under pressure. To this aim, the tanks are provided with a pressure tightening lid. The carbonic anhydride is fed to the tanks by a cylinder by means of a suitable collector member, provided with relative electric valves for discharging the exceeding pressure; single ducts branch out from the collector member, directed to the various tanks. Therefore the feed and discharge of the carbonic anhydride in each tank is performed through a single duct. In practice, the product is introduced inside each tank with the discharge electric valves opened; successively such electric valves are closed and the tanks are set under pressure through the feeding of the carbonic anhydride.

A problem which is complained by the users when using the cited apparatuses is determined by the fact that the mentioned products tend to produce a high quantity of foam. In particular, when loading the product, a lot of foam is produced inside the tank. It results that a part of the product, in the form of foam, could go up to the collector member, until obstructing the electric valves. In these conditions, the failure of the entire feed and discharge system of the carbonic anhydride can occur.

A further problem which derives therefrom is the risk of a possible overpressure inside the containment tanks.

DISCLOSURE

The task of the present invention is that of solving the aforementioned problems, devising an apparatus for preparing and dispensing carbonated refrigerated beverages which ensures a correct functioning also in presence of foam inside the tank.

Within such task, it is a further scope of the present invention that of providing an apparatus for preparing and dispensing carbonated refrigerated beverages which prevents the occurrence of overpressures.

Another object of the present invention is that of providing an apparatus for preparing carbonated refrigerated beverages having a simple conception, a securely reliable functioning and versatile use, as well as relatively economic cost.

The cited scopes are attained, according to the present invention, by the apparatus for preparing carbonated refrigerated beverages according to claim 1.

According to the present invention, the apparatus for preparing and dispensing carbonated refrigerated beverages comprises means for feeding a pressurization gas inside a containment tank for the product to be dispensed, said means being provided with single feed and discharge ducts of said pressurization gas, separately connected to said tank and provided with respective valve members for controlling the flow of the same pressurization gas.

Preferably said pressurization gas consists in carbonic anhydride.

DESCRIPTION OF DRAWINGS

Details of the invention shall be more apparent from the detailed description of a preferred embodiment of the apparatus for preparing and dispensing carbonated refrigerated beverages, illustrated for indicative purposes in the attached drawings, wherein:

FIGS. 3 and 4 show a perspective view, respectively from the front side and the rear side, of the upper part of the apparatus without covering parts;

FIG. 5 shows an increased detail of said upper part of the apparatus;

FIG. 6 shows a front view thereof at the rear side.

BEST MODE

Figure 2:
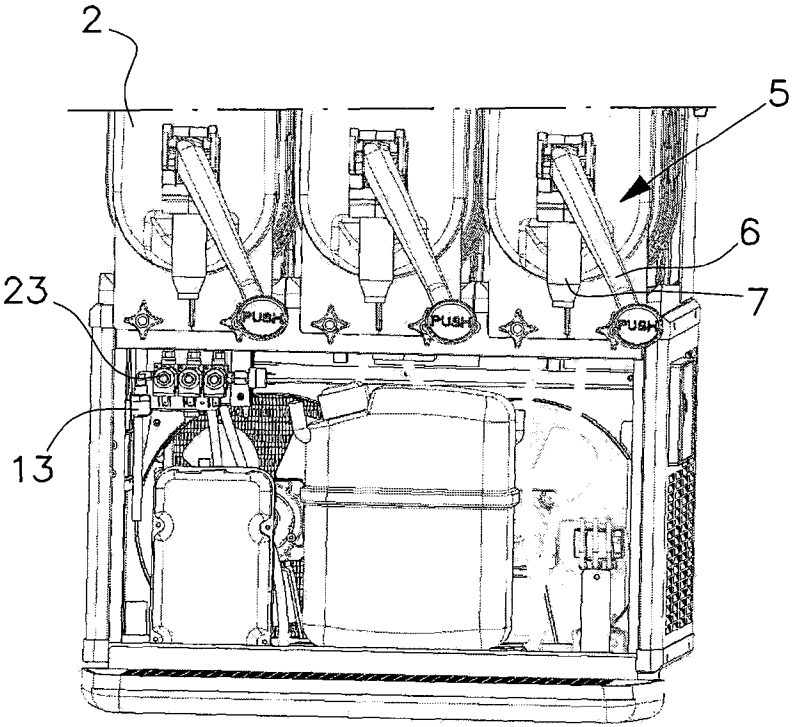
FIG. 2 shows a corresponding front view thereof, partially opened to highlight internal members.
Figure 1:
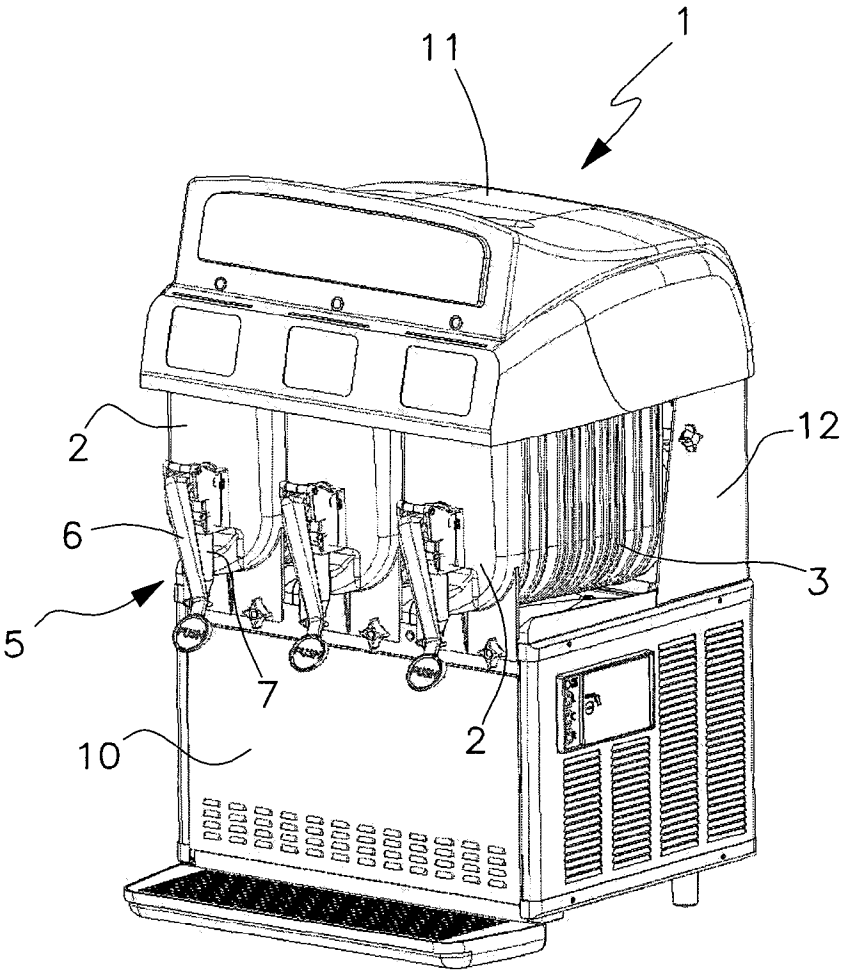
FIG. 1 shows a perspective view of the apparatus for preparing and dispensing carbonated refrigerated beverages.

With particular reference to such figures, the apparatus for preparing and dispensing carbonated refrigerated beverages, such as for example crushed-ice beverages and the like, is indicated in its entirety with 1.

The apparatus 1 provides at least one containment tank 2 for containing the product to be dispensed, preferably made of transparent plastic material. In the illustrated case the apparatus is provided with three containment tanks 2, arranged side by side on a single base body 10, but the realization of apparatuses provided with a different number of tanks, for example two, is also possible. The tanks 2 have on their sides a series of stiffening ribs 3, extended on substantially vertical planes. Each containment tank 2 is closed at the upper part by a pressure tightening lid 4; the lid is locked to the tank 2 through a series of tightening members 14 with lever actuation. In closure position, the pressure tightening is warranted by a suitable washer inserted between tank 2 and lid 4.

The base body 10 is suitable for containing in its own inside the actuation members of the apparatus, known per se and therefore not described in greater detail.

Inside the containment tank 2 is arranged, in a way known per se and therefore not specifically represented, a mixing device consisting for example in a screw member driven in rotation according to an axis longitudinal to the tank 2 to determine the continuous circulation of t he product inside the same tank 2; the screw is actuated in rotation by a gear motor 8, preferably of the brushless type, arranged at the rear part of the tank 2 (see FIG. 6). Inside the tank 2 is further arranged a cooling device for cooling the product to the suitable temperature, of a known type as well and not represented in the drawings.

The containment tank 2 has frontally a dispenser device 5 provided with an obturator member which can be actuated through an external lever member 6. The obturator member is slidable inside a cylindrical seat realized, with a substantially vertical axis, by a sleeve 7 shaped at the front part of the containment tank 2 and in communication with the inside of the same tank 2.

The tanks 2 are further connected to feed means for feeding a pressurization gas suitable for maintaining the same tanks 2 under pressure. Such a pressurization gas is suitably constituted by carbonic anhydride and is usually fed by a conventional cylinder. Each containment tank 2 is provided with a manostat 20, mounted above the relative lid 4, suitable for controlling the pressure level inside the same tank 2.

According to the present invention, the feeding and discharge of the carbonic anhydride to each containment tank 2 are realized separately through single ducts 21, 22 independent for each tank 2. The ducts 21, 22 for feeding and discharging the carbonic anhydride are intercepted by respective electric valves 23, 24 suitable for controlling the gas flow through the same ducts 21, 22. The electric valves 23 for controlling the feed ducts 21 are controlled by a single manostat 13 mounted on the link for connecting to the feed piping of carbonic anhydride (see FIG. 2). Preferably the electric valves 24 for controlling the discharge ducts 22 are of the so-called total separation type.

The product to be dispensed is fed to each tank 2 through a respective mixing valve member 25 of the so-called "post-mix" type. To the mixing member 25 are linked respective pipings 26, 27 for the discharge of the concentrated product, for example provided as a syrup, and of the carbonated water. The discharge pipings 26, 27 are provided with respective manostats 28, 29 for controlling the pressure of the syrup and of the carbonated water.

It is to be observed that the feed and discharge members for the carbonic anhydride and for the discharge of the syrup and of the carbonated water, with the relative members for controlling the flow an d the pressure, are arranged in substance in the upper part and in the rear part of the apparatus. In conditions of use such members are hidden by an upper covering carter 11 and by a rear carter 12.

The functioning of the apparatus for preparing and dispensing carbonated refrigerated beverages, such as carbonated crushed-ice beverages and the like, turns out to be easy to understand from the preceding description.

The product to be dispensed is introduced inside each tank through the relative mixing valve 25, to which are fed, by means of the respective discharge pipings 26, 27, the concentrated product and the carbonated water. In the mixing valves 25 is performed the dilution in suitable proportion of the concentrate with the carbonated water, in a way as to obtain the desired carbonated beverage. Obviously the tanks 2 placed side by side allow to prepare and dispense beverages having different tastes, for example carbonated crushed-ice beverages with various flavours.

The tanks 2 are suitably provided with level probes 15 suitable to signal the reaching of the provided filling level of the same tanks 2, arresting the feed of the product.

During the step of introduction of the so obtained product in the containment tank 2 the electric valve 24 for the discharge of the carbonic anhydride is open. Then the discharge electric valves 24 are closed and the tanks 2 are set under pressure feeding the carbonic anhydride, opening the corresponding feed electric valves 23. At the end of the step of feed of the carbonic anhydride, the feed electric valves 23 are closed so that the tank 2 results completely pressurized. Obviously the various tanks 2 can be fed with the various products also in different moments.

After having introduced the product in the tank 2 and once the desired temperature is reached, one provides to actuate the maintenance cycle. In particular the cooling device is automatically activated, setting the suitable working temperatures, and the screw member of the mixing device is driven in rotation at a predetermined rate, until reaching the aforesaid temperature. In maintenance step, a suitable temperature sensor, arranged inside the tank 2, periodically controls the temperature of the product and activates again the cooling device when necessary. When required, the dispensing of the product is performed actuating in open position the obturator member of the dispenser device 5 by means of the lever member 6.

Suitably the gear motor 8 which drives the screw mixing member is mounted tilting in a way as to engage an oscillation of the device when the resistance offered by the mixed product increases, which is to say when the level of cooling of the same product increases. Such an oscillation is suitable for activating means for controlling the cooling device in order to maintain the characteristics of the carbonated beverage constant.

The apparatus in hand attains the scope of carrying out in an optimal manner the preparation and dispense of carbonated refrigerated beverages, such as for example carbonated crushed-ice beverages and the like, ensuring a correct functioning also in presence of foam inside the tank.

In fact, in case the foam which is possibly produced inside the tank 2 at the moment of the feed of the product should go up the discharge duct 22, then it passes through the total separation electric valve 24 and does not come in contact with the coil of such electric valve. Suitably the foam is discharged in a lower small tank, in communication with the environment.

This allows in particular to avoid a failure of the apparatus when a high quantity of foam is produced.

Another advantage offered by the apparatus in h and is to avoid risks of overpressure inside the containment tanks of the carbonated beverages.

The apparatus described for indicative purpose is susceptible of numerous modifications and variants according to the diverse exigencies.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. An apparatus for preparing and dispensing carbonated refrigerated beverages, the apparatus comprising:

at least one containment tank suitable to contain a product to be dispensed and closed by a pressure tightening lid;

a means for feeding the product to be dispensed inside said containment tank;

a means for feeding a pressurization gas inside said containment tank in order to maintain the containment tank under pressure;

a mixing device arranged inside said containment tank and suitable to determine a continuous circulation of the product inside the containment tank, to convey the product towards a front zone of said containment tank;

a cooling device arranged inside said containment tank to cool said product;

a device for dispensing the product, placed at said front zone of the containment tank, said means for feeding the pressurization gas comprising a feed duct for said pressurization gas, separately connected to said containment tank and provided with a respective valve member for controlling a flow of the pressurization gas, a discharge duct for said pressurization gas separately connected to said tank and provided with a discharge duct valve member for controlling a flow of the pressurization gas, said containment tank being connected to a respective mixing valve member, which is adapted to feed the product to be dispensed to said tank, and to which are linked respective discharge pipings for respectively feeding a concentrated product and carbonated water thereto, said discharge pipings being provided with respective manostats for controlling a pressure of the concentrated product and of the carbonated water.

2. An apparatus according to claim 1, wherein said valve members of the discharge duct for said pressurization gas comprise a total separation electric valve.

3. An apparatus according to claim 1, further comprising:

another containment tank to provide a plurality of containment tanks, said containment tanks being arranged side by side and each of said containment tanks being provided with said feed and discharge ducts for the pressurization gas, separately connected to each one of said containment tanks.

4. An apparatus according to claim 1, wherein said containment tank is provided with a manostat, connected at an upper part to said pressure tightening lid, suitable to control a pressure level inside the containment tank.

5. An apparatus according to claim 1, wherein said containment tank is provided with level probes suitable to signal reaching of a suited filling level of the containment tank, arresting a load of the product.

6. An apparatus according to claim 1, wherein said pressurization gas is constituted by carbonic anhydride.

7. An apparatus according to claim 2, further comprising:

another containment tank to provide a plurality of containment tanks, said containment tanks being arranged side by side and each of said containment tanks being provided with said feed and discharge ducts for the pressurization gas, separately connected to each one of said containment tanks.

8. An apparatus according to claim 2, wherein said containment tank is provided with a manostat, connected at an upper part to said pressure tightening lid, suitable to control a pressure level inside the containment tank.

9. An apparatus according to claim 2, wherein said containment tank is provided with level probes suitable to signal reaching of a suited filling level of the containment tank, arresting a load of the product.

10. An apparatus according to claim 3, wherein at least one of said containment tanks is provided with a manostat, connected at an upper part to said pressure tightening lid, suitable to control a pressure level inside the at least one of said containment tanks.

11. An apparatus according to claim 3, wherein at least one of said containment tanks is provided with level probes suitable to signal reaching of a suited filling level of the at least one of the containment tanks, arresting a load of the product.

12. An apparatus for preparing and dispensing carbonated refrigerated beverages, the apparatus comprising:

a containment tank for containing a product to be dispensed;

a pressure tightening lid closing said containment tank;

a means for feeding the product to be dispensed inside said containment tank;

a means for feeding a pressurization gas inside said containment tank in order to maintain the containment tank under pressure;

a mixing device arranged inside said containment tank for circulating the product inside the containment tank;

a cooling device arranged inside said containment tank to cool the product;

a dispensing device for dispensing the product, said means for feeding the pressurization gas comprising a feed duct for delivering said pressurization gas to said containment tank, a feed duct valve member connected to said feed duct for controlling a flow of the pressurization gas delivered to the containment tank, a discharge duct for discharging said pressurization gas from said containment tank and a discharge duct valve member connected to said discharge duct, said feed duct and said discharge duct being separately connected to said containment tank;

a mixing valve member connected to said containment tank for feeding the product to be dispensed to said containment tank;

a first piping connected to said mixing valve, wherein a concentrated product is delivered to said mixing valve via said first piping;

a second piping connected to said mixing valve, wherein a carbonated fluid is delivered to said mixing valve via said second piping, the product comprising the concentrated product and the carbonated fluid;

a first manostat connected to said first piping, wherein a pressure of the concentrated product is controlled via said first manostat;

a second manostat connected to said second piping, wherein a pressure of the carbonated fluid is controlled via said second manostat.

13. An apparatus according to claim 12, wherein said mixing device conveys the product towards a front zone of said containment tank, said dispensing device being placed at said front zone of the containment tank.

14. An apparatus according to claim 12, wherein said feed duct comprises a feed duct outlet portion and a feed duct inlet portion, said feed duct inlet portion being directly connected to said feed duct valve member, said feed duct outlet portion being connected to a first area of said containment tank, said discharge duct comprising a discharge duct inlet portion and a discharge duct outlet portion, said discharge duct inlet portion being directly connected to said discharge duct valve member, said discharge duct outlet portion being connected to a second area of said containment tank, said second area being located at a spaced location from said second area.

15. An apparatus according to claim 12, further comprising:

a third manostat connected to said pressure tightening lid for controlling a pressure level inside the containment tank.

16. An apparatus according to claim 12, further comprising:

level probes connected to said containment tank for providing a signal as output, said signal comprising a filling level of the containment tank.

17. An apparatus according to claim 12, wherein said pressurization gas comprises carbonic anhydride.

18. An apparatus for preparing and dispensing carbonated refrigerated beverages, the apparatus comprising:

a containment tank for containing a product to be dispensed, said containment tank comprising a pressure tightening lid;

a feed duct for delivering a pressurization gas to said containment tank, said feed duct comprising a first feed duct end portion and a second feed duct end portion;

a feed duct valve member for controlling a flow of the pressurization gas delivered to the containment tank, said second feed duct end portion being connected to said feed cut valve member, said first feed duct end portion being connected to said containment tank in a first area of said containment tank;

a discharge duct for discharging said pressurization gas from said containment tank, said discharge duct comprising a first discharge duct end portion and a second discharge duct end portion;

a discharge duct valve member, said second discharge duct end portion being connected to said discharge duct valve member, said first discharge duct end portion being connected to said containment tank in a second area of said containment tank, said second area being located at a spaced location from said first area;

a mixing device arranged inside said containment tank for circulating the product inside the containment tank;

a cooling device arranged inside said containment tank to cool the product;

a dispensing device for dispensing the product, said means for feeding the pressurization gas;

a mixing valve member connected to said containment tank for feeding the product to be dispensed to said containment tank;

a first piping connected to said mixing valve, wherein a concentrated product is delivered to said mixing valve via said first piping;

a second piping connected to said mixing valve, wherein a carbonated fluid is delivered to said mixing valve via said second piping, the product comprising the carbonated fluid and the concentrated product;

a first manostat connected to said first piping, wherein a pressure of the concentrated product is controlled via said first manostat;

a second manostat connected to said second piping, wherein a pressure of the 35 carbonated fluid is controlled via said second manostat.

19. An apparatus according to claim 18, wherein said first piping has a first piping first end portion and a first piping second end portion, said first piping first end portion being connected to said mixing valve and said first piping second end portion being connected to a supply of the concentrated product, said second piping comprising a second piping first end portion and a second piping second end portion, said second piping first end portion being connected to said mixing valve, said second piping second end portion being connected to a supply of the carbonated fluid.

20. An apparatus according to claim 19, wherein said first feed duct end portion is connected to said containment tank in a first lid area of said lid, said first discharge duct end portion being connected to a second lid area of said lid, said second lid area being located at a spaced location from said first lid area.

* * * * *